US012685375B1

(12) United States Patent
Richmond et al.

(10) Patent No.: US 12,685,375 B1
(45) Date of Patent: Jul. 21, 2026

(54) HAIR STYLING APPARATUS

(71) Applicant: Robots and Donuts, Carson, CA (US)

(72) Inventors: David Richmond, Carson, CA (US); Jeffrey Kunkler, Carson, CA (US); Donald Craig Priess, Carson, CA (US)

(73) Assignee: Robots and Donuts, Carson, CA (US)

( * ) Notice: Subject to any disclaimer, the term of this patent is extended or adjusted under 35 U.S.C. 154(b) by 0 days.

(21) Appl. No.: 19/258,765

(22) Filed: Jul. 2, 2025

(51) Int. Cl.
*A45D 2/38* (2006.01)

(52) U.S. Cl.
CPC ..... *A45D 2/38* (2013.01)

(58) Field of Classification Search
None
See application file for complete search history.

(56) References Cited

U.S. PATENT DOCUMENTS

| | | | | | |
|---|---|---|---|---|---|
| 523,962 | A | | 7/1894 | Dixon | |
| 666,732 | A | | 1/1901 | Bertin | |
| 804,680 | A | | 11/1905 | Smith | |
| 957,142 | A | | 5/1910 | Brodhead | |
| 1,574,418 | A | | 2/1926 | Coviello | |
| 2,489,582 | A | * | 11/1949 | Mccready | A46B 13/02 601/87 |
| 2,674,995 | A | | 4/1954 | Marino | |
| 5,511,270 | A | * | 4/1996 | Eliachar | A46B 13/02 601/72 |
| 6,283,930 | B1 | * | 9/2001 | Purvis | A46B 5/0041 601/72 |
| 8,342,187 | B2 | * | 1/2013 | Kalman | A45D 24/10 119/609 |
| 2007/0180638 | A1 | | 8/2007 | McKay | |
| 2008/0209648 | A1 | * | 9/2008 | Taggart | A61H 7/005 15/21.1 |
| 2014/0107543 | A1 | | 4/2014 | Pazouki | |

FOREIGN PATENT DOCUMENTS

| | | | | |
|---|---|---|---|---|
| EP | 4484086 | | 1/2025 | |
| KR | 101919290 | B1 * | 11/2018 | A46B 17/04 |
| KR | 200491228 | Y1 * | 3/2020 | A46B 5/0041 |
| WO | 2001000057 | | 1/2001 | |
| WO | 2007102160 | | 9/2007 | |
| WO | 2009096289 | | 8/2009 | |
| WO | 2013113014 | | 8/2013 | |

OTHER PUBLICATIONS

Translation, KR-101919290-B1 (Year: 2018).*
Translation, KR-200491228-Y1 (Year: 2020).*

* cited by examiner

*Primary Examiner* — David S Posigian
*Assistant Examiner* — Dana Lee Poon
(74) *Attorney, Agent, or Firm* — Smyrski Patent Law PC

(57) ABSTRACT

A hairstyling brush is provided. The hairstyling brush includes a handle, a brush head joined to the handle, the brush head comprising a spiral cantilever beam originating from a peripheral edge of the brush head and spiraling inward to a central position, and a vibration motor and counterweight arrangement proximate the central position.

13 Claims, 9 Drawing Sheets

HAIR STYLING APPARATUS

BACKGROUND

I. Field

The present invention relates generally to the art of hair styling devices, and more particularly to hair styling devices used to curl hair.

II. Background

Hair styling devices such as combs and brushes have been employed for years to enhance the appearance of the user. Such devices offer certain benefits such as removing tangles and knots. Brushing helps to separate the hair strands and prevent them from becoming tangled, making hair easier to manage and style. Brushing also helps to distribute natural oils from the scalp throughout the hair that can help keep hair healthy and shiny. Brushing can further help to remove dirt, dust, and other debris from the hair and stimulate the scalp, which can promote blood flow and hair growth.

Hair styling devices are generally divided into two types, the first being "flat iron" devices. Flat iron devices employ a hinged pair of arms, with one each side of the hinge including a lower plate that heated by passing electricity through wires contained within. The heating element plate lies beneath a surface plate that contacts the hair and that has traditionally been made of various materials. Currently a number of flat iron hair treatment devices are offered that include upper or surface plates formed from materials including aluminum, steel, ceramic, titanium, and/or tourmaline. In normal operation, the user turns on the device, the device applies electricity to wires passing through the heating element plate to cause heating, in turn heating the surface plate. The user places strands of her hair between a pair of such surface plates, one on each arm of the styling device, and closes the sides using the hinge provided. The user then pulls the closed flat iron device away from her head and the heating effect tends to break the bonds in the cortex of the hair. The result is a "straightening" or "styling" of the hair. The user then repeats this process over other strands of hair as desired.

Another type of device used to straighten or curl hair is called a "styling iron" device. Such devices come in different forms, but in one form it entails a similar hinged pair of arms, one arm including a heating element that is curved in a concave orientation, while the other arm employs a rotating cylindrical element that fits with the concave element. Frequently brush bristles are offered on the heated side, and the heating element is electrically powered and may comprise various materials, such as the aforementioned ceramic, titanium, and tourmaline, and/or composites employing such materials. In most instances, the rotating element is formed of a plastic material and is not heated, but certain styling irons may employ heating in the rotating element. In this manner, hair can either be straightened or it can be curled; individuals with straight hair can employ a styling iron to apply a fairly even gentle curl to their hair.

Issues with the foregoing types of devices primarily include heating and pulling of the hair. Such devices can in certain instances produce excessive heat, which in extreme cases can be a fire hazard but may in certain instances damage user hair. Pulling hair results when peripheral items such as clamps or clips or joints between parts catch strands of hair and pull them during normal operation. Hair styling devices that employ arms that clamp can cause hair pulling.

Such pulling can cause pain and discomfort as well as the loss of desired hair. Damage and breakage can also occur, wherein hair styling devices having stiff bristles or such devices used aggressively can damage the hair shaft, leading to breakage, split ends, and frizz. Further, certain hairstyling devices, such as brushes and detanglers, struggle to effectively remove knots and tangles, requiring excessive force and potentially causing hair damage.

Vibrating hairbrushes are commonly available. Typical mechanisms employed in vibrating hair brushes include a gear train that receives rotation input of relatively high rpm DC power and converts the power to a lower frequency with a resultant increase in torque. Vibration results from the rotation moving a bristle holding element, and as a result of the gear train operation, such designs tend to be inefficient and noisy. In such vibrating systems, the more mass that a vibrating source must move the more the source vibration is dampened. The vibration amplitude is also reduced as the inertia of the mass resists accelerations from the vibration source. The higher the vibration frequency, the more easily damped it becomes, and the shorter the range for effectively imparting inertia into a surrounding media (air, water, hair, etc.) In order to detangle hair, bristles are preferably moved far enough in their vibration path such that they effectively engage the hair. This engagement needs to be long enough and slow enough to overcome the hair's inertia so that the energy imparted from the bristles moves the hair back and forth. Too fast or too slow a vibration can be undesirable. As a result of the foregoing, previous vibrating hairstyling devices tend to be inefficient and noisy.

It would therefore be beneficial to offer a hair styling apparatus that addresses issues with previous hair styling devices.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its sole purpose is to present some concepts in a simplified form as a prelude to the more detailed description that is presented later.

According to one embodiment, there is provided a hairstyling brush comprising a handle, a brush head joined to the handle, the brush head comprising a spiral cantilever beam originating from a peripheral edge of the brush head and spiraling inward to a central position, and a vibration motor and counterweight arrangement proximate the central position.

According to a further embodiment, there is provided a powered hairstyling brush comprising a handle, a brush head comprising a spiral cantilever beam originating from a peripheral edge of the brush head and spiraling inward to a central position, and a vibration motor and counterweight arrangement at least partially disposed within the central position.

According to another embodiment, there is provided a hairstyling brush comprising a handle, a brush head joined to the handle, the brush head comprising a spiral cantilever beam originating from a peripheral edge of the brush head and spiraling inward to a center open region, and a vibration motor comprising a counterweight arrangement positioned at least partially within the center open region.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

In this document, the words "embodiment," "variant," and similar expressions are used to refer to particular apparatus, process, or article of manufacture, and not necessarily to the same apparatus, process, or article of manufacture. Thus, "one embodiment" (or a similar expression) used in one place or context can refer to a particular apparatus, process, or article of manufacture; the same or a similar expression in a different place can refer to a different apparatus, process, or article of manufacture. The expression "alternative embodiment" and similar phrases are used to indicate one of a number of different possible embodiments. The number of possible embodiments is not necessarily limited to two or any other quantity.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make or use the invention, and not to limit the scope of legal protection afforded the invention, which is defined by the claims and their equivalents.

Figure 1:
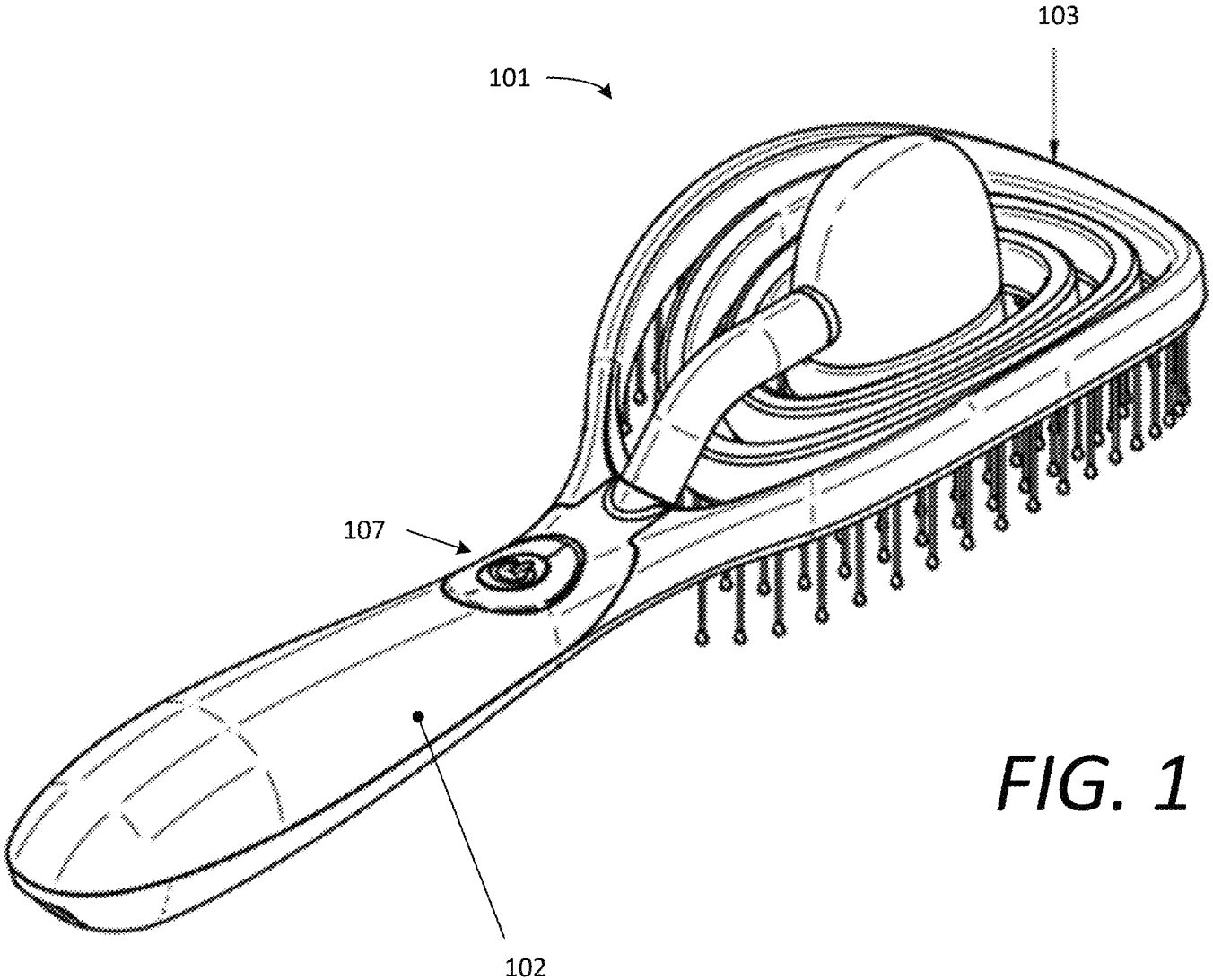
FIG. 1 illustrates a perspective view of the back side of the vibrating hair styling brush.
Figure 2:
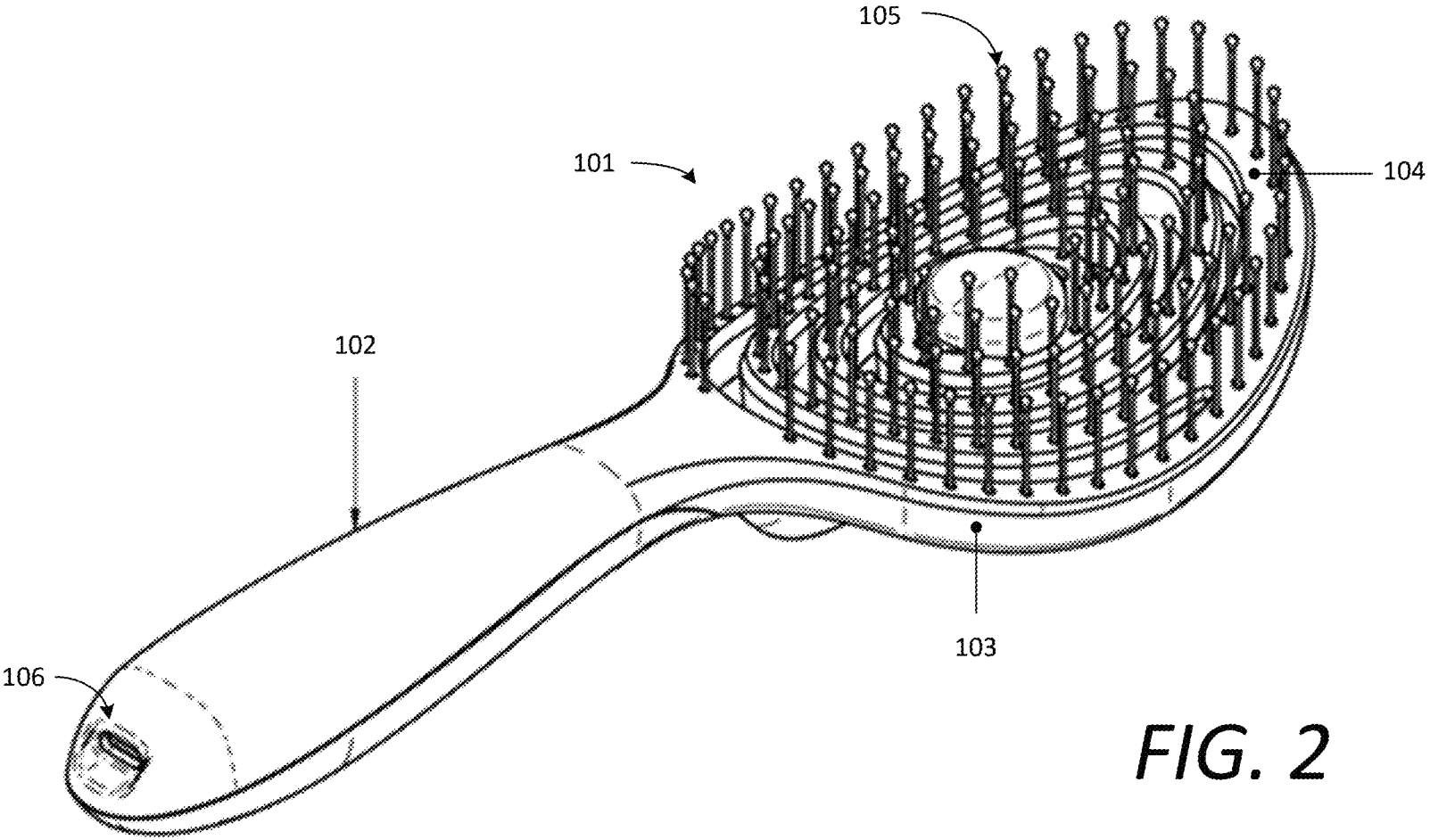
FIG. 2 is a perspective view of the front side of the vibrating hair styling brush.
Figure 3:
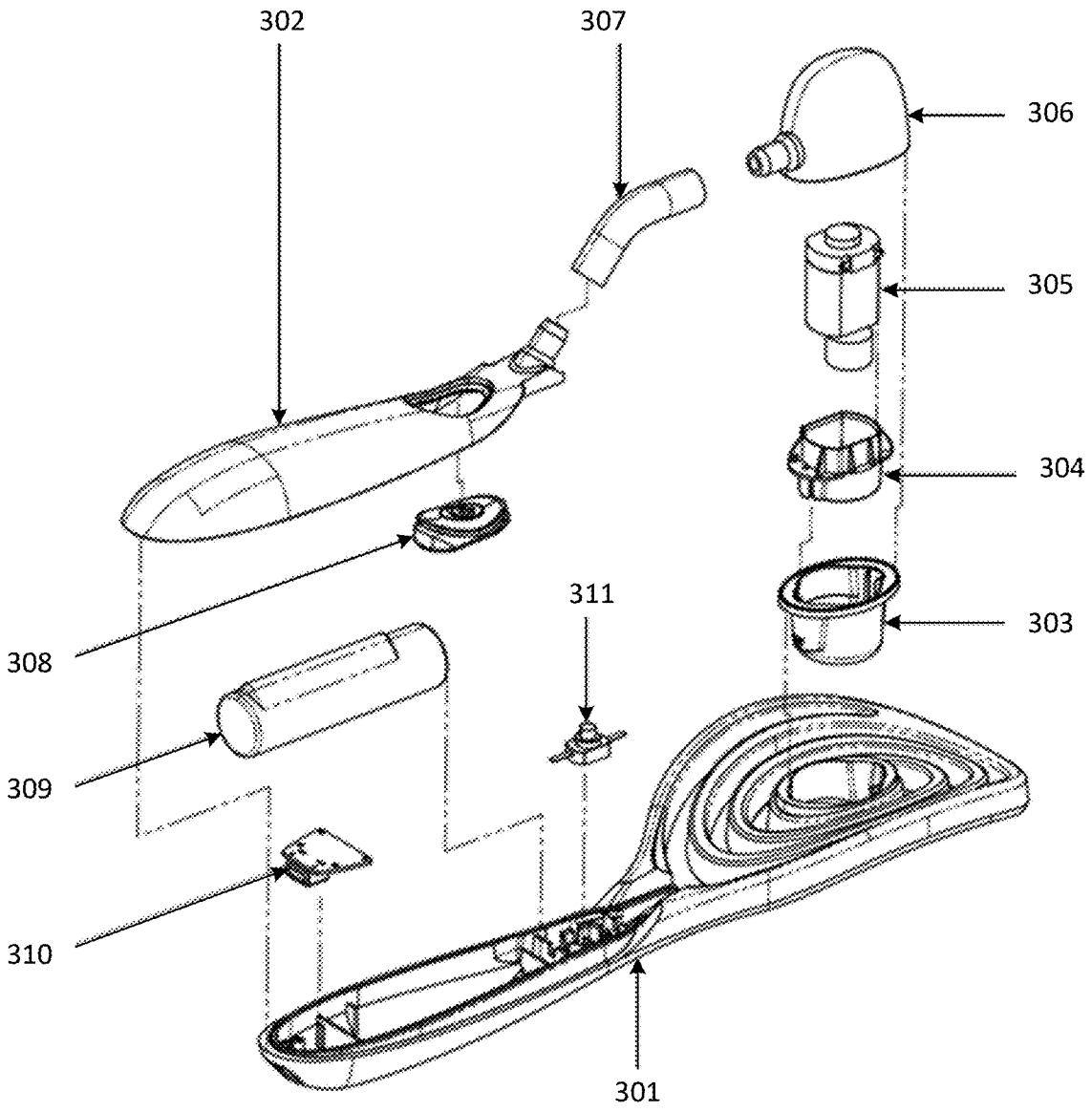
FIG. 3 is an exploded view of the vibrating hair styling brush.

FIGS. 1, 2, and 3 show a vibrating brush design that employs a vibration motor and counterweight assembly positioned centrally within a spiral cantilever beam that includes openings on the bottom and top thereof. In other words, the spiral cantilever beam is a single spiral form that results in an opening such that when the vibration motor and counterweight assembly is operating the spiral moves and flexes laterally back and forth, thus styling the hair of the user. From FIG. 8, a top view of the hair styling apparatus 101, the wire guide positioned below can be seen and the vibration motor and counterweight assembly cause the spiral to move generally in an up and down manner in the orientation shown.

The present design thus provides a hand held brush used in a manner similar to a detangling brush. From FIGS. 1 and 2, hair styling apparatus 101 has a handle 102 for gripping and a brush head 103 attached in line to one end of handle 102. The face 104 of brush head 103 has a spiral form and includes bristles and/or molded protrusions that engage the hair, such as protrusion 105, mounted on the spiral in this embodiment. In operation, the user holds hair styling apparatus 101 by handle 102 and engages bristles into hair on the user's head, with the bristle side or face of hair styling apparatus 101 perpendicular to the natural direction of the hair. The user holds handle 102 such that movement of the brush by the user is along the natural direction of the hair. The user typically pulls downward, or out, away from the scalp, with handle 102 perpendicular to the direction of motion while hair styling apparatus 101 is turned on and the bristles are moving in a back and forth direction via the spiral cantilever arm.

Hair styling apparatus 101 may maintain a rechargeable battery or power source (not shown). Hair styling apparatus 101 may further include an electronic PWA (printed wire assembly) or similar device, such as a PCB (printed circuit board), positioned for example in handle 102. Hair styling apparatus 101 may include a charging port 106 on, for example, the distal end of handle 102. A power switch 107 may be provided with or mounted into handle 102. Other power sources may be employed including but not limited to standard 120 v AC power received from a standard electrical outlet via an electrical plug. The battery or other power source may provide power to a motor such as a small de electric motor that rotates a small weight offset from the axis rotation of the motor. Rotation of the offset weight creates vibration. In one embodiment, the motor is mounted into the middle of brush head 103. The design allows for transmission of vibration to brush head 103 and thus the bristles. The opposite side of brush head 103, the side opposite bristles 105 and face 104, has a smooth obround surface which can be used to massage the scalp, face and neck.

The present design provides low frequency/high amplitude vibration by mounting the motor on a flexible spiral cantilever beam. The spiral cantilever beam has a motor in the center of the brush head at the free end of the spiral cantilever beam in one embodiment. This construction provides for vibration of the specific bristles provided, with such vibration facilitating detangling and scalp massage as well as other benefits. When a user engages the bristles into the hair, vibration separates hair fibers without pulling the hair. Refraining from excessively pulling the hair reduces hair loss, pain, and lessens the force needed to pull the brush through the hair. Additionally, the vibration provides relaxation and stimulation to the scalp.

Figure 4:
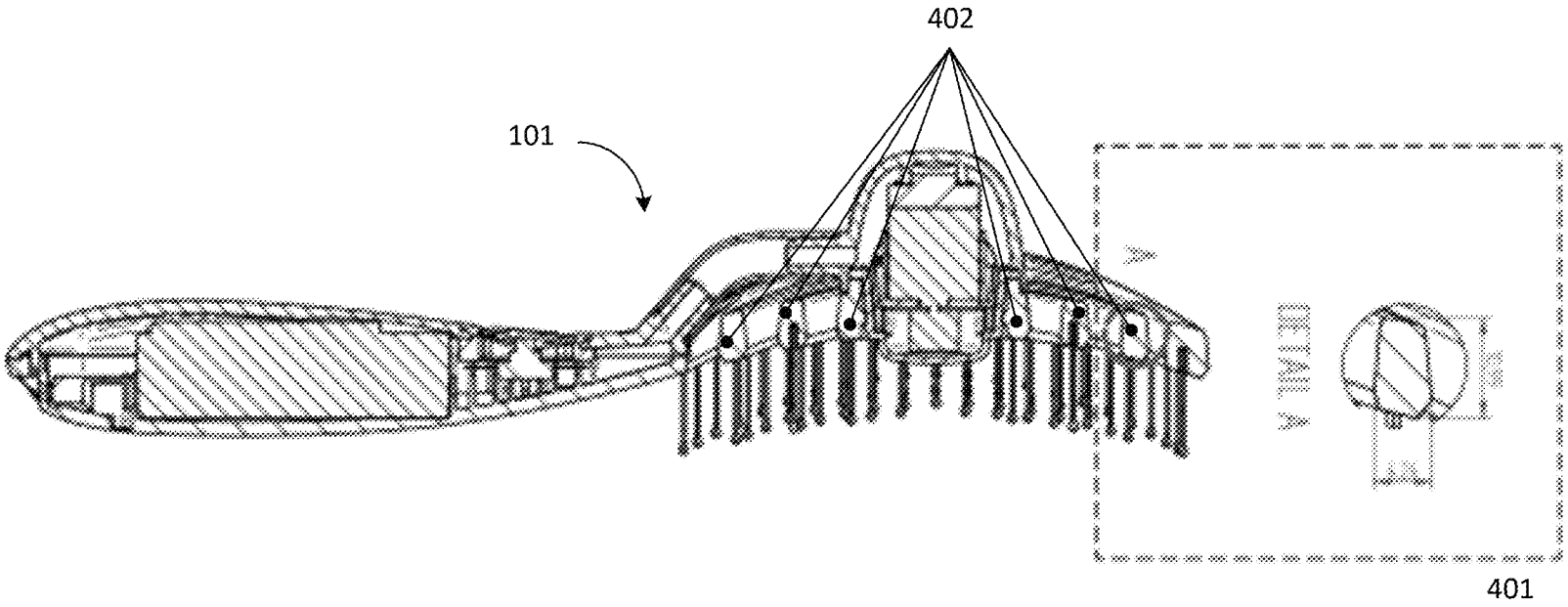
FIG. 4 is a right side cutaway view of the vibrating hair styling brush.
Figure 8:
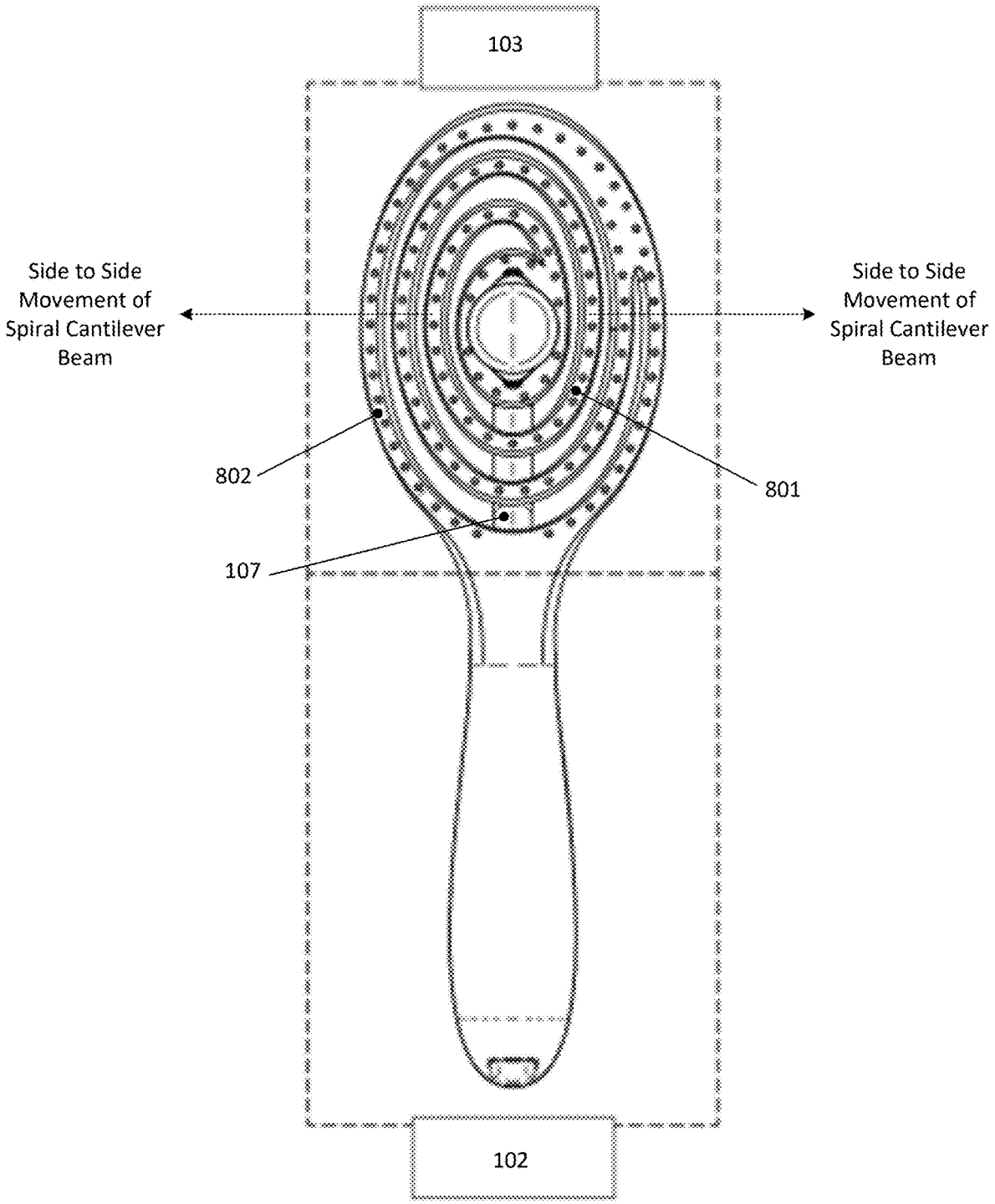
FIG. 8 is a top view of the surface or face of the vibrating hair styling brush.

Hair styling apparatus 101 may be formed primarily of rigid molded plastic such as ABS or similar, providing stiffness and toughness. The shape of the outside perimeter of head 103 may be a complete elliptical loop. In one embodiment, dimensions of head 103 are approximately 80 mm in width and 120 in length as measured in-line with handle 102. Within this ellipse is a single cantilevered beam 402 that attaches or is provided on the rim of the elliptical loop and ends at the center of the elliptical loop. The spiral loop 801 is shown in FIG. 8. Beam 402 has a uniform cross-section as shown in FIG. 4, detail 401. The bending action of the cantilever construction is consistent along its length, which in one embodiment is approximately 400 mm.

From FIG. 4 detail 401, the cross-section of the cantilever arrangement is taller in the direction of the bristle length (up-and-down direction) and narrower in the direction perpendicular to the bristles (side-to-side direction). Height of the beam cross section is approximately 10 mm in this embodiment, and width of the beam cross section is approximately 6 mm. The longer geometry in the up and down direction biases side-to-side vibration while providing the beam with enough flexibility follow the shape of the scalp.

From FIG. 3, vibration motor and counterweight assembly 305 mounts into motor skirt 302, which may be injection molded. Motor skirt 304 is held into upper motor cover 306 and lower motor cover 303. A seal is provided between motor skirt and upper motor cover 306, in any manner appropriate, for example by an ultrasonic weld. The assembly, including upper motor cover 306, vibration motor and counterweight assembly 305, motor skirt 304, and lower motor cover 303, fits into the portion of head 102 of main body 301. One motor that may be employed in the design is a 3-6 volt motor with an approximately 20 mm diameter body, such that the length including motor shaft of the embodiment is on the order of 38 mm.

The counterweight in this embodiment may be cylinder of brass or similar high density metal, in this embodiment having a diameter of 11.5 mm wide by 8.5 mm thick. Distance between counterweight center axis and motor shaft axis, as well as the dimensions, weight, and composition of the counterweight, may vary to achieve a desired beat frequency or particular type of operation. In one embodiment, distance between counterweight center axis and motor shaft axis is a few millimeters, specifically no more than 10 mm.

Control PCB 310 fits into the interior of main body 301 with locating pins molded into main body 301. Control PCB may have a USB C or other appropriate port on its distal end. In the case of a USB C port, the port fits to an opening in the distal end of Main Body 301. Such a port may have a form-fitting elastomer ring or other seal or barrier around the port, such as a USB C port, that presses to the interior surfaces of the main body 301, forming in this embodiment a water resistant seal. Upper handle 302 maintains control PCB 310) in place when affixed to main body 301.

Battery 309, which may be a Li-ion or other type battery as appropriate, may include an overcharge protection circuit and fits to molded-in features in the interior of main body 301. Main body 301 is held in position by upper handle 302 when affixed to main body 301.

In this embodiment, power switch 311, which may be a latching push-on/push-off activation switch, is maintained and positioned by formed or molded-in features of main body 301. In this embodiment, the top portion of power switch 311 includes an activation plunger, fits into features provided on the underside of switch cover 308 when all parts are properly assembled. Switch cover 308 may be formed of an elastomer or similar material.

Upper handle 302 may be formed of an injection molded plastic such as ABS (Acrylonitrile Butadiene Styrene) or similar. Features are molded into upper handle 202 to hold switch cover 308 and the wire guide tube 407, which may also be formed of an elastomer or similar material. Upper handle 302 in this embodiment may be welded, such as ultrasonically welded to main body 301, providing a water resistant seal. Wire guide 307 thus provides a water resistant path for the wires running to vibration motor subassembly 305 between handle cover 302 and upper motor cover 306.

Figure 5:
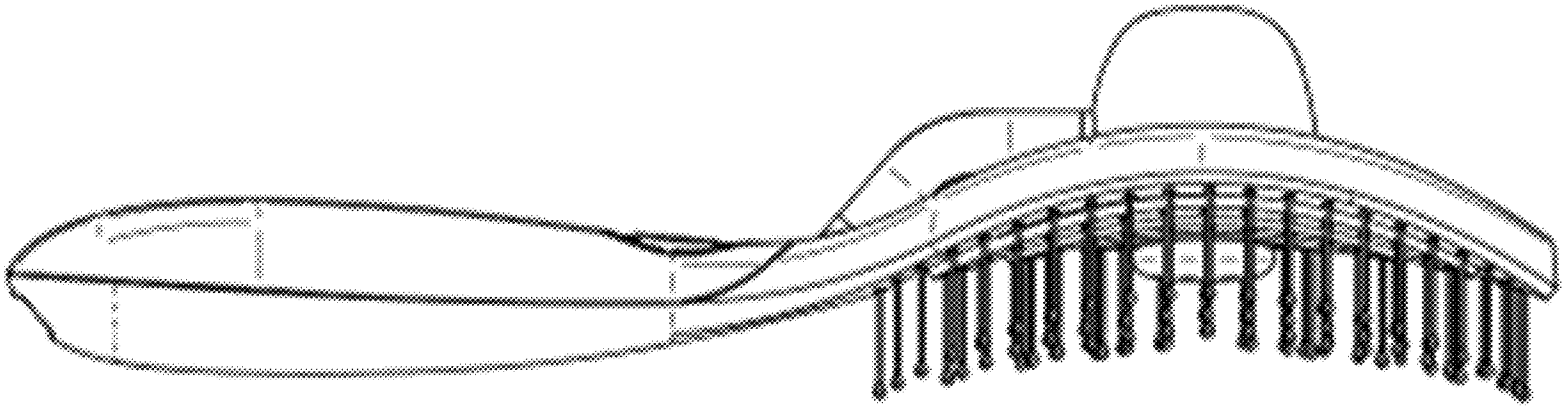
FIG. 5 is a right side view of the vibrating hair styling brush.
Figure 6:
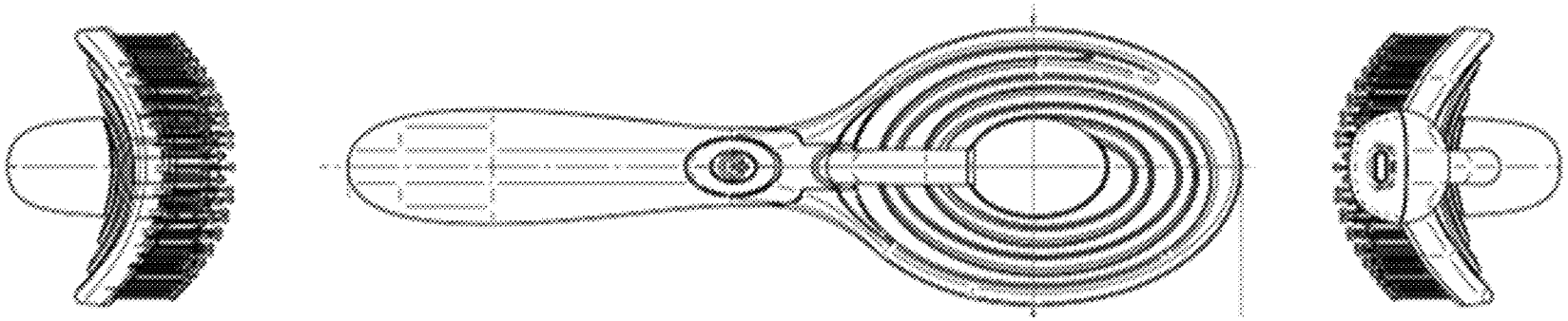
FIG. 6 is a top view of the vibrating hair styling brush as well as a rear view from the perspective of the bottom of the handle and a front view from the perspective of the top of the brush head.
Figure 7:
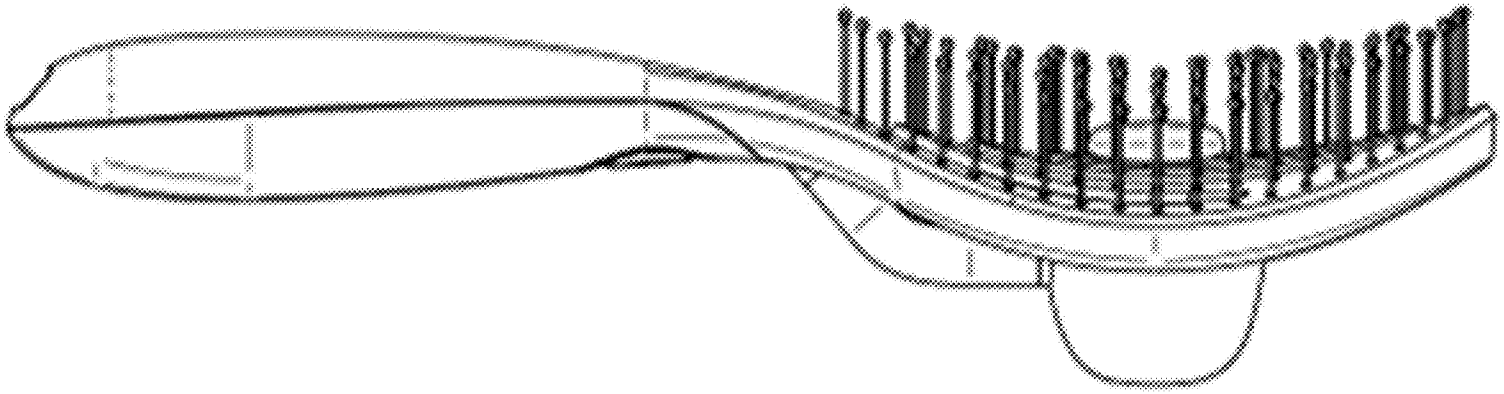
FIG. 7 is a left side view of the vibrating hair styling brush.

FIGS. 4 through 8 represent alternate views of the present design. FIG. 4 is a cutaway view with a detail of the cantilever aspect of the design. FIG. 5 is a right side view of hair styling apparatus 101 with bristles down, while FIG. 6, from left to right, presents a front, top, and rear view of hair styling apparatus 101. FIG. 7 is a left side view of hair styling apparatus 101 with bristles up, while FIG. 8 shows a top view of hair styling apparatus 101 and the spiral path or presentation of the bristles, delineating generally the head and the handle of hair styling apparatus 101. From FIG. 8, spiral 801 moves in the directions shown, while the exterior 802 includes bristles but does not move. Thus the user typically engages both fixed bristles and moving bristles when brushing her hair with hair styling apparatus 101 turned on.

Figure 9:
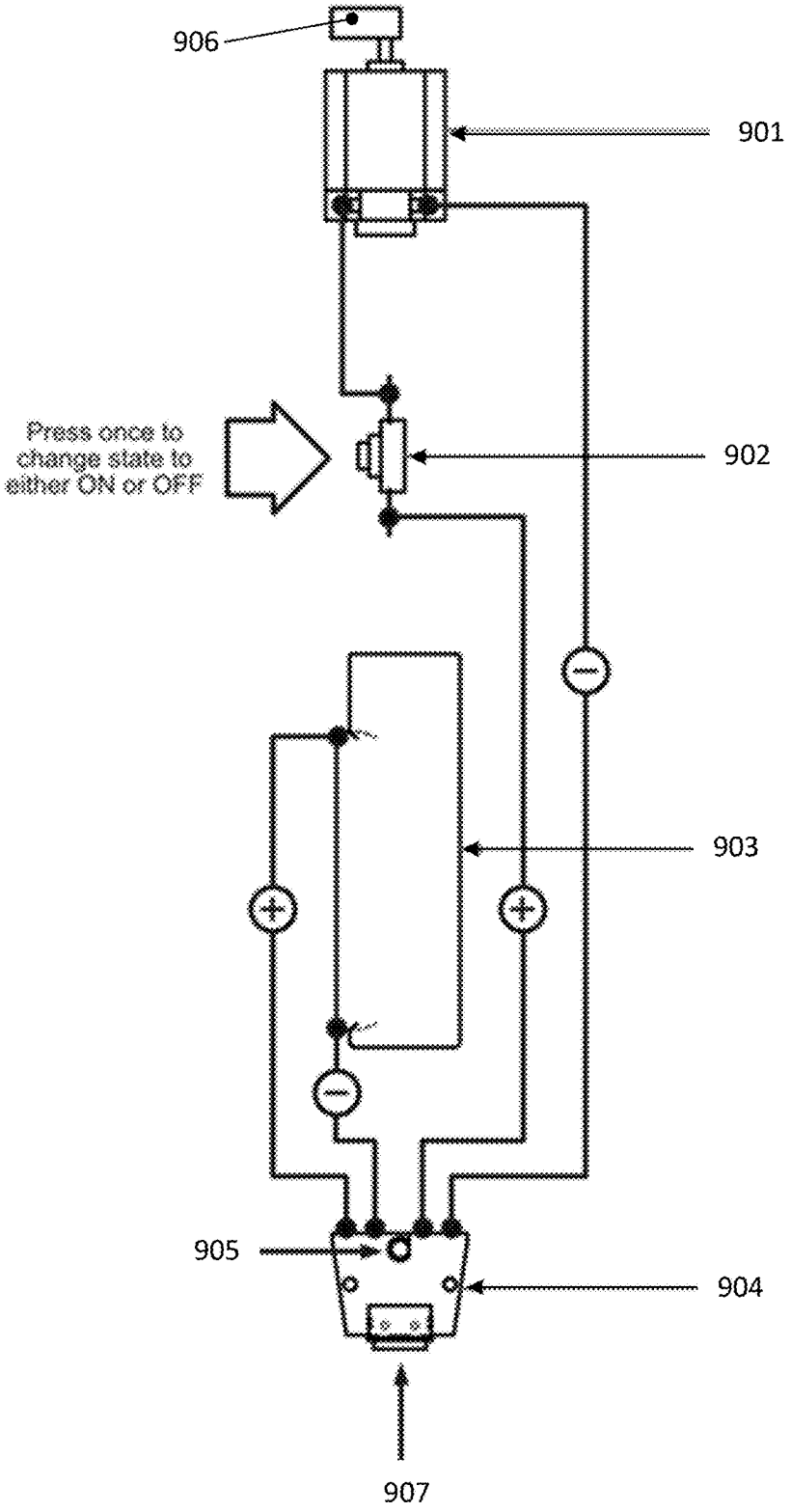
FIG. 9 is a view of one embodiment of electronics usable in the present design.

FIG. 9 illustrates the wiring arrangement for Wiring Schema and Functional description. From FIG. 9, vibration motor and counterweight assembly 901 includes counterweight 906, while power switch 902 operates to switch on and off with in this embodiment a single press or actuation. Battery 903 is shown which may be a lithium ion (Li-ion) battery, and control PCB 904 is shown with LED 905 showing charging status. USB-C connector 907 is shown in this embodiment for charging battery 903, but other charging options may be provided.

During operation, in general the motor does not run while the unit is charging, such as when a charge cord is attached to hair styling apparatus 101 and is providing power. Four conditions are generally provided, the first being the no battery power condition where when the battery is discharged to too low a level to operate control PCB 904, power switch 902 has no effect. The second power condition is no battery power with the charge cord connected. In this state, control PCB 904 sets the status of power switch 902 to OFF and commences charging battery 903. Control PCB 904 also causes LED 905 to flash indicating charging has commenced. As battery 903 charges, flashing of LED 905 may change to indicate level of charge until LED 905 becomes solid indicating full charge. Multiple LEDs may be provided and may be employed to illustrate charge level, for example.

The third condition is battery 903 having enough charge to power the motor with the charge cord not connected. In this condition, if the state of power switch 902 is OFF and hair styling apparatus 101 is on Standby. No LED indication of state of charge may occur if desired. vibration motor and counterweight assembly 901 The system then starts. When a user shuts off the unit after use, LED 905 may flash a series of indications showing charge status. The fourth condition is battery power dropping below motor cutoff during use, wherein control PCB 904 does not allow battery 903 to run vibration motor and counterweight assembly 901 when power in battery 903 drops below a desired power level, including but not limited to 50, 25, 15, 10, or other percentage levels. When the power level drops below this level and hair styling apparatus 101 is in use, the system may stop vibration motor and counterweight assembly 901 and LED 905 may flash to indicate vibration motor and counterweight assembly 901 needs to be charged. Such flashing may continue for a desired period of time or indefinitely. If x hair styling apparatus 101 is not charging and the user attempts to power on the device, such action does not power the motor and causes the device to flash the LED to indicate need for charge for a predetermined period of time, such as five or ten seconds, and shut off.

The present design employs heterodyning, combining a high frequency signal with another signal to produce a lower frequency signal, using a cantilever beam that possesses a natural resonant frequency in coordination with a rotating motor/counterweight. The spiral orientation of the bristles and the cantilever design provide a beat frequency significantly lower than either of the two input frequencies, namely the frequency of the rotating counterweight minus the natural frequency of the cantilever beam to produce a desired beat frequency. In one embodiment, the beat frequency is approximately 4 Hz with an amplitude of about 3 mm.

Use of heterodyning provides a relatively strong low frequency vibration that works very well at untangling hair. In the embodiment shown, the brush can be moved through user hair with 20 to 25 percent less force on average than comparable detangling brushes. This design allows for efficiently imparting energy into the hair and results in a simpler, more effective, and lower cost device than has been previously available.

The embodiment shown uses a single spiral cantilever beam. More than one beam may be employed as long as the heterodyne effect still operates. More than one cantilever beam may be employed and the design could use tuned masses at the ends of a matrix of beams to tune for multiple frequencies. The single cantilever beam allows for a simple design that provides a good, even vibration across the entire face of the brush head while allowing for the longest cantilever beam to achieve the desired natural resonance.

The bristles are important in the energy path to produce the desired level of vibration, The bristles balance flexibility for comfort versus stiffness enough to impart vibration without undue discomfort on the scalp. Our embodiment uses nylon bristles of 0.7 mm in diameter, and a length of 18 mm, which yields a good balance of stiffness and flexibility. However other bristle arrangements and constructions can be employed including injection molding the bristles as part of the brush head or using different bristle materials or bundles of smaller diameter bristles or even bundling different bristles to achieve additional hair effects such as polishing.

The present design drives the motor at full battery voltage. Alternately, the design may employ pulse width modulation (PWM) control that applies control signals to tune the motor/counterweight rpms and optimize vibration. As desired, possibly based on force feedback, i.e. the force encountered when using hair styling apparatus 101 where greater force is needed to overcome resistance from the user brushing her hair with the device, the system may apply higher rpms for the motor/counterweight, and lower rpms when less resistance is encountered and less force is required.

The user may control the rpm rate either by establishing a setting or causing the rotation to alter dynamically such as via a switch or command. Alternately, an accelerometer may be employed in the head to sense and feed acceleration back to the PWM control to adjust rotation rate dynamically in order to maintain the beat frequency at a desired or desirable level.

The current apparatus utilizes the cantilever beam natural resonant frequency coupled with the rotational vibration of the small counterweight spun by the DC motor at the free end of the beam. The heterodyne action serves to generate a significantly larger amplitude than vibration of the offset mass rotation alone. The design of the cantilever beam as a single long beam arranged having a spiral shape produces a cantilever beam length that lowers the natural resonant frequency and takes advantage of the ABS material's tensile/compression properties.

More than one cantilever beam may be employed, where lengths of the cantilever beams have natural frequencies that can enhance overall amplitude and beat frequencies.

Thus the present design in the embodiment shown takes advantage of a single spiral cantilever beam with a maximized in the given overall size with an easily molded spiral shape and motor at the center of the brush head. The center of the brush head is also the free end of the beam, thus providing an attractive appearance while generating sufficient vibration. The spiral shape in one embodiment is formed into a hyperbolic paraboloid shape. The motor and counterweight are located such that the plane of rotation of the motor driven counterweight is in line with the base of the fore-aft arch of the hyperbolic parabolic and tangent to the side-to-side curvature of the hyperbolic paraboloid. Such an offset allows for adding a rocking motion to the beam motion, yielding an additional up-down vibration to the bristles in the orientation of, for example, FIG. 7, resulting in added scalp stimulation.

According to one embodiment, there is provided a hairstyling brush comprising a handle, a brush head joined to the handle, the brush head comprising a spiral cantilever beam originating from a peripheral edge of the brush head and spiraling inward to a central position, and a vibration motor and counterweight arrangement proximate the central position.

According to a further embodiment, there is provided a powered hairstyling brush comprising a handle, a brush head comprising a spiral cantilever beam originating from a peripheral edge of the brush head and spiraling inward to a central position, and a vibration motor and counterweight arrangement at least partially disposed within the central position.

According to another embodiment, there is provided a hairstyling brush comprising a handle, a brush head joined to the handle, the brush head comprising a spiral cantilever beam originating from a peripheral edge of the brush head and spiraling inward to a center open region, and a vibration motor comprising a counterweight arrangement positioned at least partially within the center open region.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A hairstyling brush comprising:

a handle;

a brush head joined to the handle, the brush head when viewed from above comprising a spiral cantilever beam originating from a peripheral edge of the brush head and spiraling inward to a central open position, the spiral cantilever beam having a fixed end integral with the peripheral edge and a free end terminus at the central open position, wherein the brush head has a first concave curved shape when viewed from a side of the brush head from the handle to a tip of the hairstyling brush and a second convex curved shape when viewed from a forward-facing position of the brush head extending from side to side of the hairstyling brush; and a vibration motor and counterweight arrangement mounted at the free end terminus of the spiral cantilever beam at the central open position;

wherein the vibration motor produces a motor frequency and the spiral cantilever beam has a natural resonant frequency, and wherein a beat frequency produced by interaction of the motor frequency and the natural resonant frequency is lower than either the motor frequency or the natural resonant frequency of the spiral cantilever beam.

2. The hairstyling brush of claim 1, further comprising a first plurality of bristles positioned on the spiral cantilevered beam.

3. The hairstyling brush of claim 2, further comprising a second plurality of bristles positioned on the peripheral edge of the brush head.

4. The hairstyling brush of claim 1, wherein operation of the vibration motor and counterweight arrangement causes portions of the spiral cantilever beam to move in a side to side motion.

5. The hairstyling brush of claim 4, wherein operation of the vibration motor and counterweight arrangement causes portions of the spiral cantilever beam to move in an up and down motion when viewed from the side of the brush head.

6. A powered hairstyling brush comprising:

a handle;

a brush head comprising a spiral cantilever beam originating from a peripheral edge of the brush head and spiraling inward to a central open position, the spiral cantilever beam having a fixed end integral with the peripheral edge and a free end terminus at the central open position, wherein the brush head has a first concave curved shape when viewed from a side of the brush head, and a second convex curved shape when viewed from a forward-facing position of the brush head; and a vibration motor and counterweight arrangement mounted at the free end terminus of the spiral cantilever beam;

wherein the vibration motor produces a motor frequency and the spiral cantilever beam has a natural resonant frequency, and wherein a beat frequency produced by interaction of the motor frequency and the natural resonant frequency is lower than either the motor frequency or the natural resonant frequency of the spiral cantilever beam.

7. The powered hairstyling brush of claim 6, further comprising a first plurality of bristles positioned on the spiral cantilevered beam.

8. The powered hairstyling brush of claim 7, further comprising a second plurality of bristles positioned on the peripheral edge of the brush head.

9. The powered hairstyling brush of claim 6, wherein operation of the vibration motor and counterweight arrangement causes portions of the spiral cantilever beam to move in a side to side motion.

10. The powered hairstyling brush of claim 6, wherein operation of the vibration motor and counterweight arrangement causes portions of the spiral cantilever beam to move in an up and down motion when viewed from the side of the brush head.

11. A hairstyling brush comprising:

a handle;

a brush head joined to the handle, the brush head comprising a spiral cantilever beam originating from a peripheral edge of the brush head and spiraling inward to a center open region, the spiral cantilever beam having a fixed end integral with the peripheral edge and an unattached free end terminus at the center open region wherein the brush head has a first concave curved shape when viewed from a side of the brush head, and a second convex curved shape when viewed from a forward-facing position of the brush head; and a vibration motor comprising a counterweight arrangement passing completely through the center open region from a reverse side of the brush head to a forward facing side of the brush head wherein the vibration motor produces a motor frequency and the spiral cantilever beam has a natural resonant frequency, and wherein a beat frequency produced by interaction of the motor frequency and the natural resonant frequency is lower than either the motor frequency or the natural resonant frequency of the spiral cantilever beam.

12. The hairstyling brush of claim 11, further comprising a first plurality of bristles positioned on the spiral cantilevered beam and a second plurality of bristles positioned on the peripheral edge of the brush head.

13. The hairstyling brush of claim 11, wherein operation of the vibration motor causes portions of the spiral cantilever beam to move in a side to side motion and an up and down motion viewed from a side of the hairstyling brush.

* * * * *